US008401447B2

(12) United States Patent
Takada

(10) Patent No.: US 8,401,447 B2
(45) Date of Patent: Mar. 19, 2013

(54) IMAGE FORMING APPARATUS

(75) Inventor: Mikihiko Takada, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 278 days.

(21) Appl. No.: 12/859,843

(22) Filed: Aug. 20, 2010

(65) Prior Publication Data

US 2011/0044737 A1 Feb. 24, 2011

(30) Foreign Application Priority Data

Aug. 24, 2009 (JP) ..... 2009-192936
Aug. 28, 2009 (JP) ..... 2009-197872

(51) Int. Cl.
*G03G 15/20* (2006.01)

(52) U.S. Cl. ..... 399/329

(58) Field of Classification Search ..... 399/324, 399/325, 326, 328, 329
See application file for complete search history.

(56) References Cited

U.S. PATENT DOCUMENTS 7,546,078 B2 * 6/2009 Okuda et al. ..... 399/329
7,917,074 B2 * 3/2011 Takada ..... 399/329
8,014,710 B2 * 9/2011 Hasegawa ..... 399/325

FOREIGN PATENT DOCUMENTS

JP 11-45018 A 2/1999
JP 2007-79036 A 3/2007

* cited by examiner

*Primary Examiner* — Hoang Ngo
(74) *Attorney, Agent, or Firm* — Cantor Colburn LLP

(57) ABSTRACT

An image forming apparatus includes: a fixing apparatus having: a heating section and a pressing section that forms a fixing-nip portion by being in pressure contact with the heating section, wherein at least one of the heating section and the pressing section having: an endless fixing belt that is trained about a plurality of rollers, a pressure applying member that causes the fixing belt to be in pressure contact with a side of the fixing-nip portion from an inner circumferential surface thereof, and a lubricant supplying member that supplies lubricant to the inner circumferential surface of the fixing belt; and a supplying amount change section that changes a supplying amount of the lubricant by the lubricant supplying member based on an amount used coming from a part replacement of at least one of the fixing belt, the pressure applying member and the lubricant supplying member.

8 Claims, 11 Drawing Sheets

IMAGE FORMING APPARATUS

This application is based on Japanese Patent Application Nos. 2009-192936 filed on Aug. 24, 2009 and 2009-197872 filed on Aug. 28, 2009, which are incorporated hereinto by reference.

BACKGROUND OF THE INVENTION

The present invention relates to an image forming apparatus equipped with a fixing apparatus that fix a toner image on a sheet by heating, pressurizing and by fixing the toner image.

Heretofore, as fixing apparatuses to be used in image forming apparatuses of an electro photographic type such as copying machines, printers, facsimile machines and multifunctional peripherals having function of the aforesaid machines, those of a heating roller type (which is also called heat-fixing roller type) including those covering low speed machines to high speed machines, and those of types of black and white and types of colors, have been widely used. The fixing apparatus of a heating roller type is one wherein a transfer material on which an unfixed toner image is formed is heated and pressurized, by the fixing nip section formed by the heating roller kept to be at a prescribed temperature, and by the pressurizing roller that has an elastic layer and pressure-contacts the heating roller.

A recent demand for color images and for high speed imaging makes a width of a nip to be broader to heat toner on a sheet surface efficiently. In this case, there are considered a way to enlarge two roller diameters or a way to enlarge an amount of distortion (strain) of a roller by enhancing a force of pressure contact between rollers for the purpose of broadening a nip width in the fixing apparatus of the aforesaid heating roller type for its structure. However, when the device of this kind is employed, there are caused problems of a large-sized fixing apparatus and of a lowered durability of the fixing apparatus, resulting in lowered degree of freedom for design conditions.

As a method to solve the problem of this kind, a fixing apparatus of a belt-nip type wherein an endless fixing belt driven by a roller to rotate and a pressure applying member fixed on the inner circumferential surface side are provided, and a fixing belt is pressed against the heating roller by the pressure applying member, has started to be used recently. In the fixing apparatus of a belt-nip type, its structure makes a width of a fixing nip to be broader than that in the heating roller type.

In the fixing apparatus of a belt-nip type, it is structured so that a fixing belt is made to contact the heating roller by the fixed pressure applying member. Therefore, if the sliding resistance in the case of sliding between the inner surface of the fixing belt and the pressure applying member is great, running of the fixing belt is disturbed, resulting in image registration deviation and sheet crease, or a cause for an increase of drive torque.

For the problem of this kind, Unexamined Japanese Patent Application Publication No. H11-045018 and Unexamined Japanese Patent Application Publication No. 2007-079036 disclose a fixing apparatus on which a lubricant supplying member that coats lubricants on an inner circumferential surface of the fixing belt is provided.

Though lubricant is coated on an inner circumferential surface of a fixing belt by a lubricant supplying member in each of Unexamined Japanese Patent Application Publication No. H11-045018 and Unexamined Japanese Patent Application Publication No. 2007-079036, an appropriate amount of coating for lubricant varies depending on the conditions of the fixing apparatus. For example, the conditions of the fixing apparatus are the occasions when the fixing belt, the pressure applying member, the lubricant supplying member and other parts of the fixing apparatus are replaced. Immediately after replacement of the fixing belt with a fresh belt, an inner circumferential surface of the fixing belt has not been coated with lubricant. Therefore, sliding resistance between the pressure applying member and the fixing belt is increased, resulting in the cause of drive torque increase.

When an amount of supplying lubricants is increased, lubricants can be supplied quickly immediately after the replacement, but in the ordinary state, an excessive supply of lubricants is caused, resulting in a problem that an excessive lubricants takes a roundabout route to the surface of the fixing belt to move to the sheet.

In view of the problem mentioned above, an object of the invention is to make an amount of lubricants to be supplied to the fixing belt to be appropriate by changing an amount of lubricants to be supplied depending on the state of the fixing apparatus, and thereby to reduce sliding resistance and to prevent contamination of a sheet by lubricant.

SUMMARY OF THE INVENTION (1) To achieve the abovementioned object, an image forming apparatus reflecting one aspect of the present invention is an image forming apparatus having therein a heating section and a pressing section that forms a fixing-nip portion by contact with the heating section with pressure wherein at least one of the heating section and the pressing section has a fixing apparatus that is equipped with an endless fixing belt that is trained about plural rollers, a pressure applying member that causes the fixing belt to contact with the fixing-nip side with pressure from an inner circumferential surface, and with a lubricant supplying member that supplies lubricants to the inner circumferential surface of the fixing belt, and a supplying amount change section that changes a supplying amount of lubricants by the aforesaid lubricant supplying member based on an amount used coming from a part replacement of at least one of the aforesaid fixing belt, the pressure applying member and the lubricant supplying member.

(2) An image forming apparatus having therein a heating section and a pressing section that forms a fixing-nip section by contacting with the heating section with pressure wherein at least one of the heating section and the pressing section has a fixing apparatus that is equipped with an endless fixing belt that is trained about plural rollers, a pressure applying member that causes the fixing belt to contact with the fixing-nip section side from the inner circumferential surface side, and with a lubricant supplying member that supplies lubricants to the inner circumferential surface of the fixing belt, and a supplying amount change section that changes a supplying amount for the lubricants based on a pause time counted from an interruption of operations of the fixing apparatus.

(3) An image forming apparatus having therein a heating section and a pressing section that forms a fixing-nip section by contacting with the heating section with pressure wherein at least one of the heating section and the pressing section has a fixing apparatus that is equipped with an endless fixing belt that is trained about plural rollers, a pressure applying member that causes the fixing belt to contact with the fixing-nip section side from the inner circumferential surface side and with a lubricant supplying member that supplies lubricants to the inner circumferential surface of the fixing belt, a drive current measuring section that measures drive current of drive motor that drives the fixing belt, and a supplying amount change section that changes a supplying amount for the lubricants based on a measured value of the drive current measuring section.

(4) The image forming apparatus described in any one of the aforesaid (1)-(3), wherein the lubricant supplying member is in touch with one of the plural rollers, and the supplying amount change section changes a supply amount by changing at least one of a contact pressure against the roller of the lubricant supplying member and a contact width.

(5) The image forming apparatus described in any one of the aforesaid (1)-(3), wherein one of the aforesaid plural rollers is a heating roller having therein a built-in heater touching the inside of the fixing belt, the lubricant supplying member is in touch with the heating roller, and the supplying amount change section changes a supplying amount by changing a controlled temperature of the aforesaid heater.

(6) The image forming apparatus described in the aforesaid (1), wherein the supplying amount change section is one to change a supplying amount by manual operations of an operator, and there is provided an operation and display section that displays on the aforesaid operation and display section information that urges operations of the supplying amount change section for an operator, based on the amount used coming from the part replacement.

(7) The image forming apparatus described in any one of the aforesaid (1)-(3), wherein plural lubricant supplying members are provided, and a supplying amount of each of the aforesaid plural lubricant supplying members is different from others, and a change of the supplying amount of the supplying amount change section is made by switching the lubricant supplying member to be used.

(8) The image forming apparatus described in any one of the aforesaid (1)-(7), wherein the pressure applying member is equipped with a pressure contact releasing section that can switch to the state of pressure contact releasing, and when changing a supplying amount so that the supplying amount change section may increase a supplying amount, the pressure applying member is caused to be in the releasing state by the pressure contact releasing section, and lubricant coating process wherein the fixing belt is rotated is carried out.

(9) Further, to achieve the abovementioned object, a fixing apparatus reflecting one aspect of the present invention is a fixing apparatus having therein a fixing member that heats a toner image to fix it on a recording material, a fixing belt, a pressure applying member that applies the fixing belt on the fixing member, a lubricant coating section that coats lubricants on a surface of the fixing belt coming in contact with the pressure applying member, a drive section that drives the fixing belt and a pressing force change section that changes pressing force of the pressure applying member, wherein there are provided a fixing process for fixing a toner image and a lubricant coating process that gives lubricants to the pressure applying member and to the fixing belt, and in the lubricant coating process, the drive section causes the fixing belt and the lubricant coating device to move relatively to coat the lubricant on the fixing belt, and in the lubricant coating process, the pressing force change section presses the pressure applying member against the fixing belt under the pressing force that is smaller than that in the fixing process.

(10) The fixing apparatus described in the aforesaid (9), wherein the pressure applying member has a pressing pad and a sliding member that covers the pressing pad, and a lubricant layer is formed on the sliding member in the lubricant coating process.

(11) The fixing apparatus described in the aforesaid (9) or the aforesaid (10), wherein a heating section that heats the fixing belt is provided, and the aforesaid heating section operates in at least the aforesaid lubricant coating process.

Figure 6A:
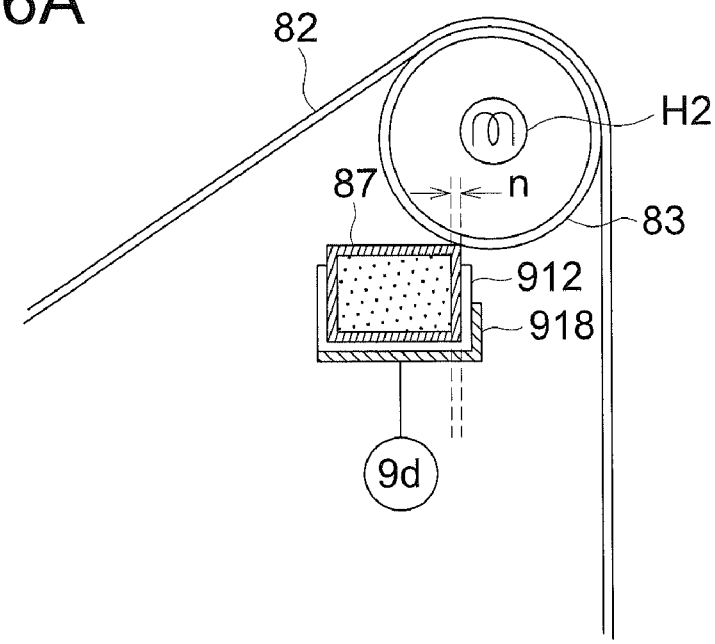
Figure 6B:
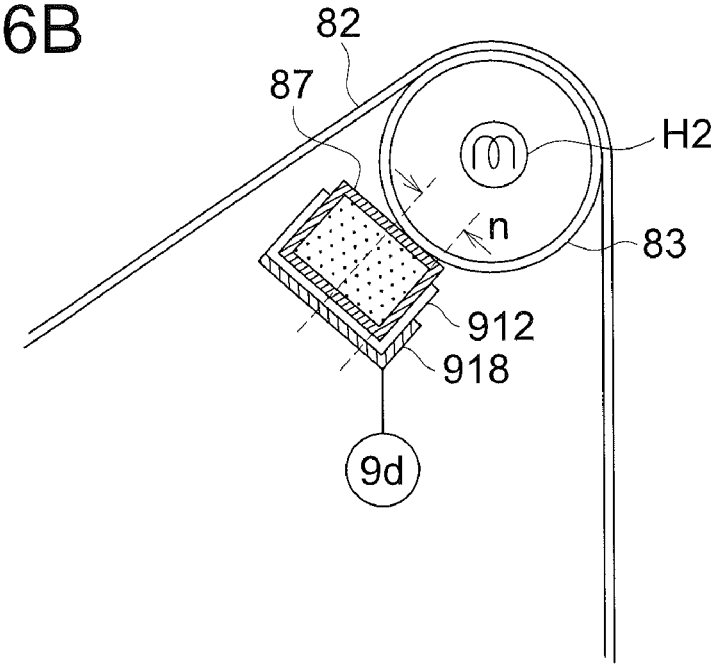

Each of FIGS. 6A and 6B shows an example of a supplying amount change section relating to the third Example.

Figure 7:
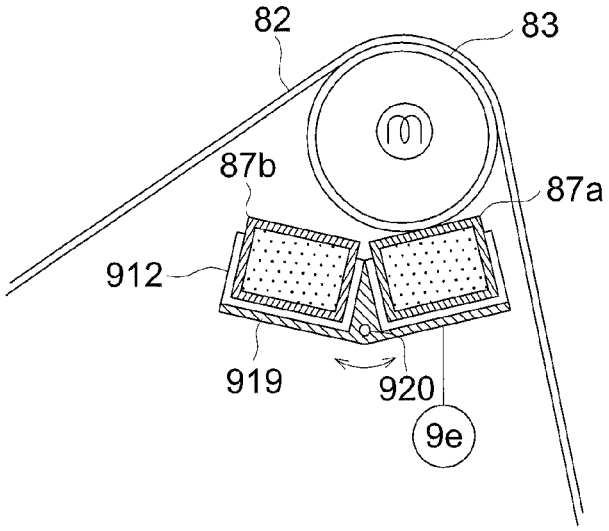

FIG. 7 is an example of a supplying amount change section relating to the fourth Example.

Figure 8:
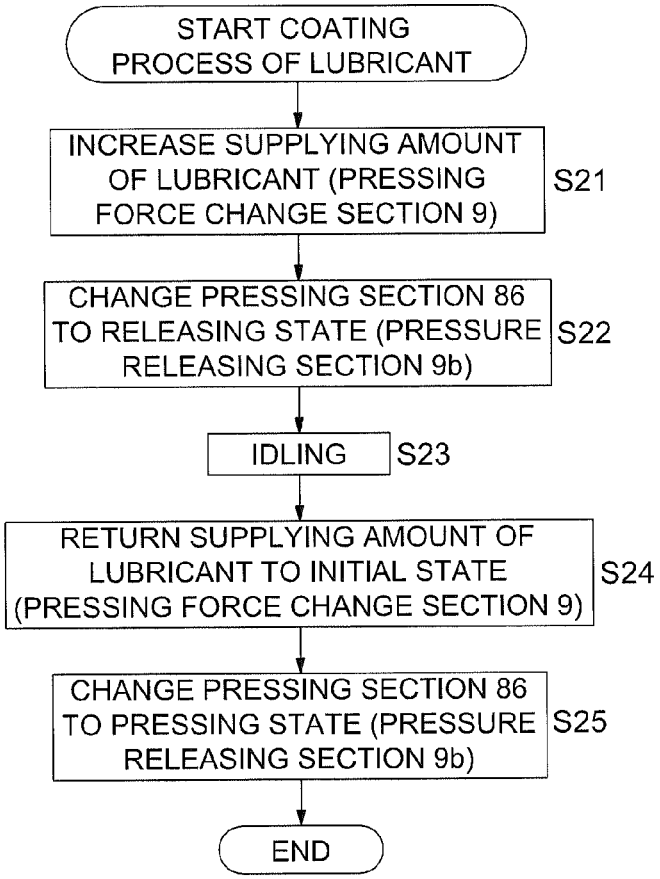

FIG. 8 is an illustration of a control flow concerning lubricant coating process that is carried out by control section 50.

Figure 9:
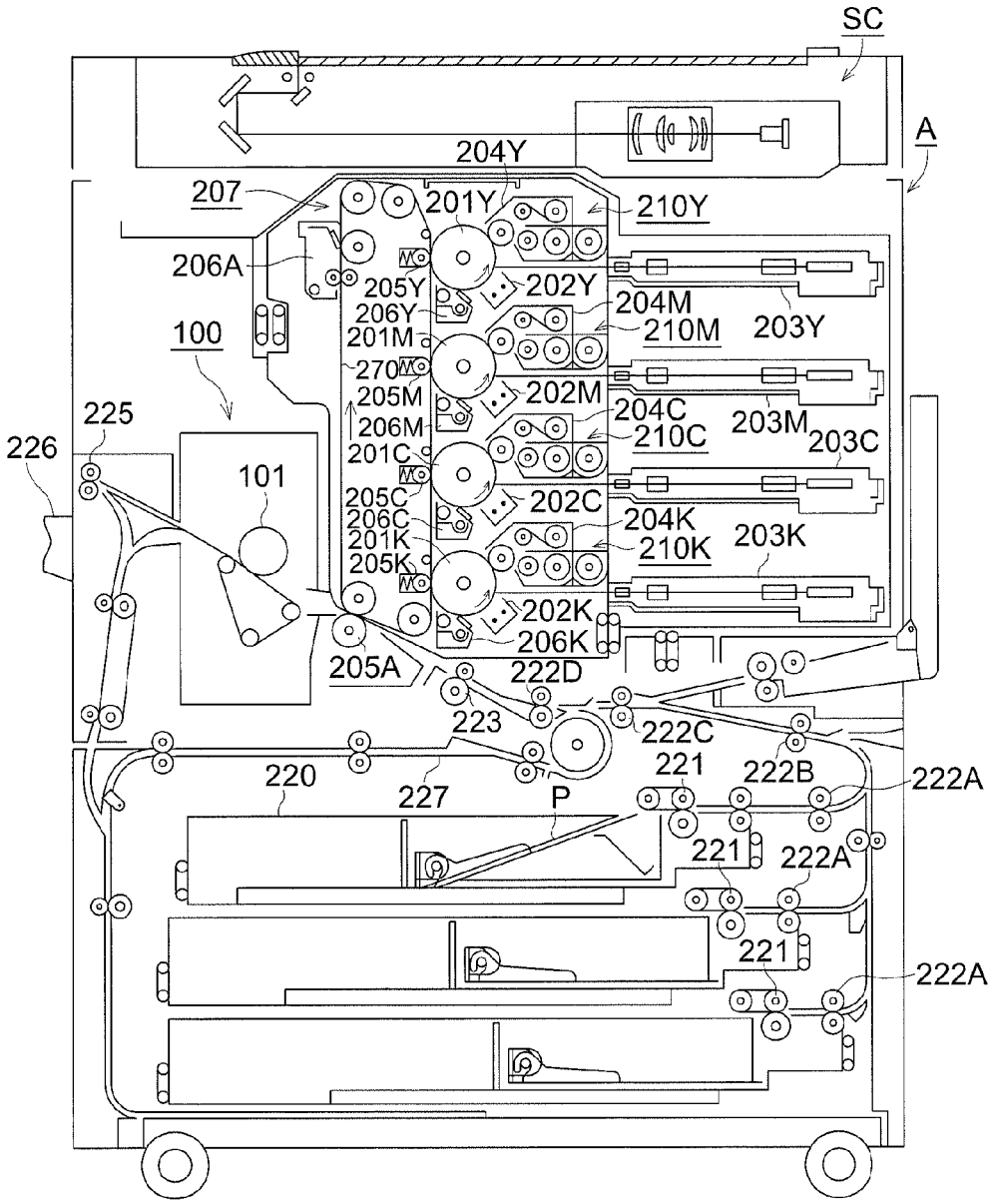

FIG. 9 is a diagram showing a color image forming apparatus employing a fixing apparatus relating to another example of the invention.

Figure 10A:
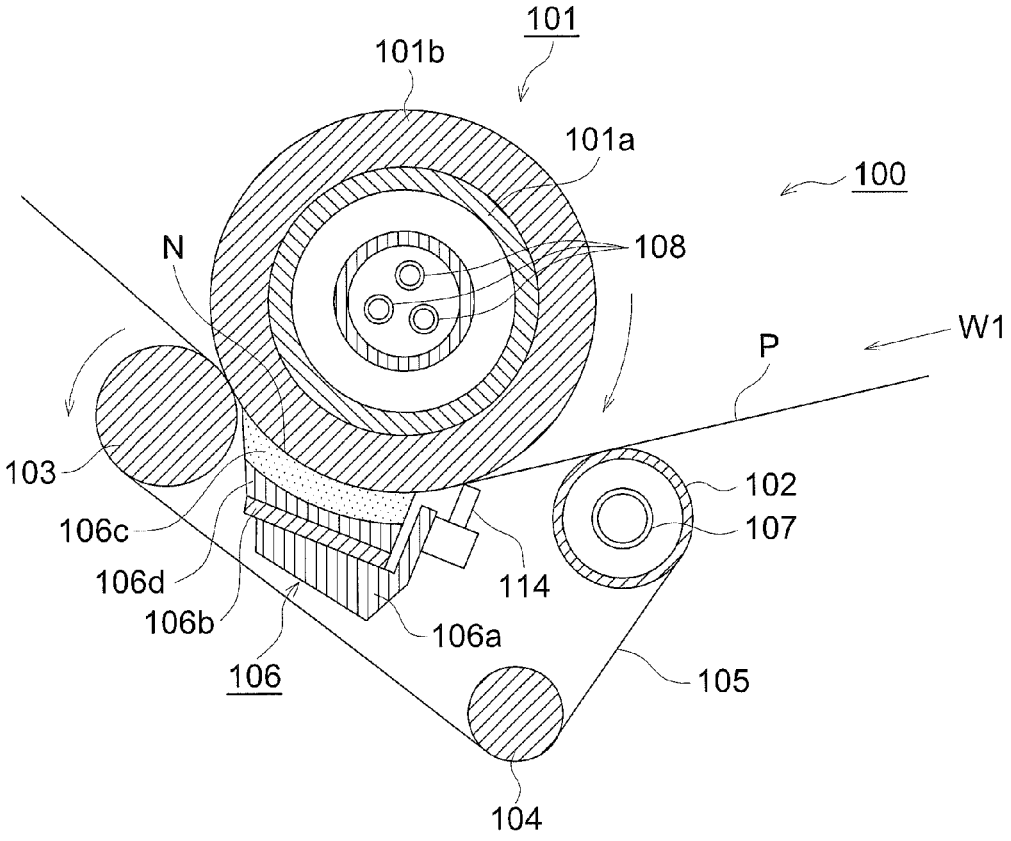
Figure 10B:
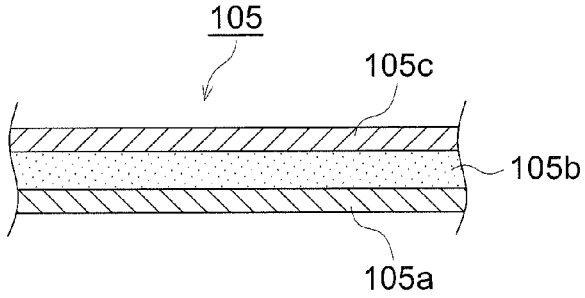

FIGS. 10A and 10B are diagrams showing construction of fixing apparatuses 100 relating to the embodiment of the invention.

Figure 11:
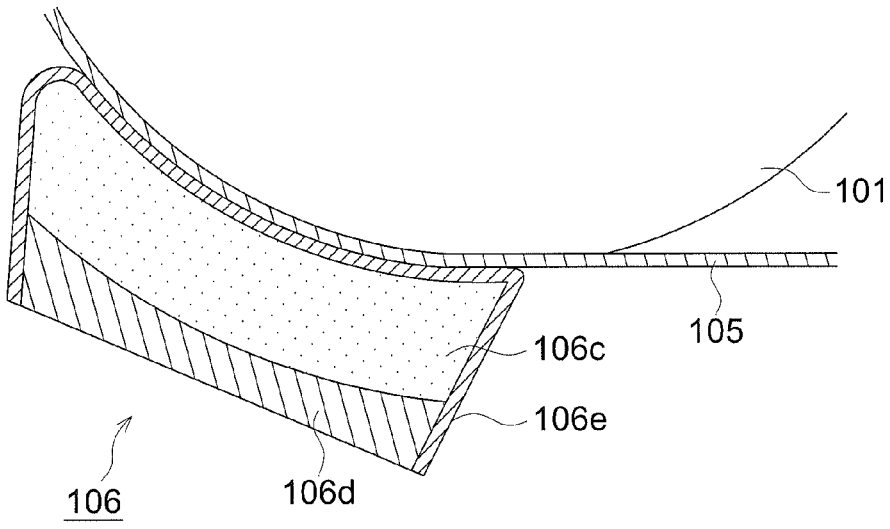

FIG. 11 is a diagram showing a pressure applying member 106.

Figure 12:
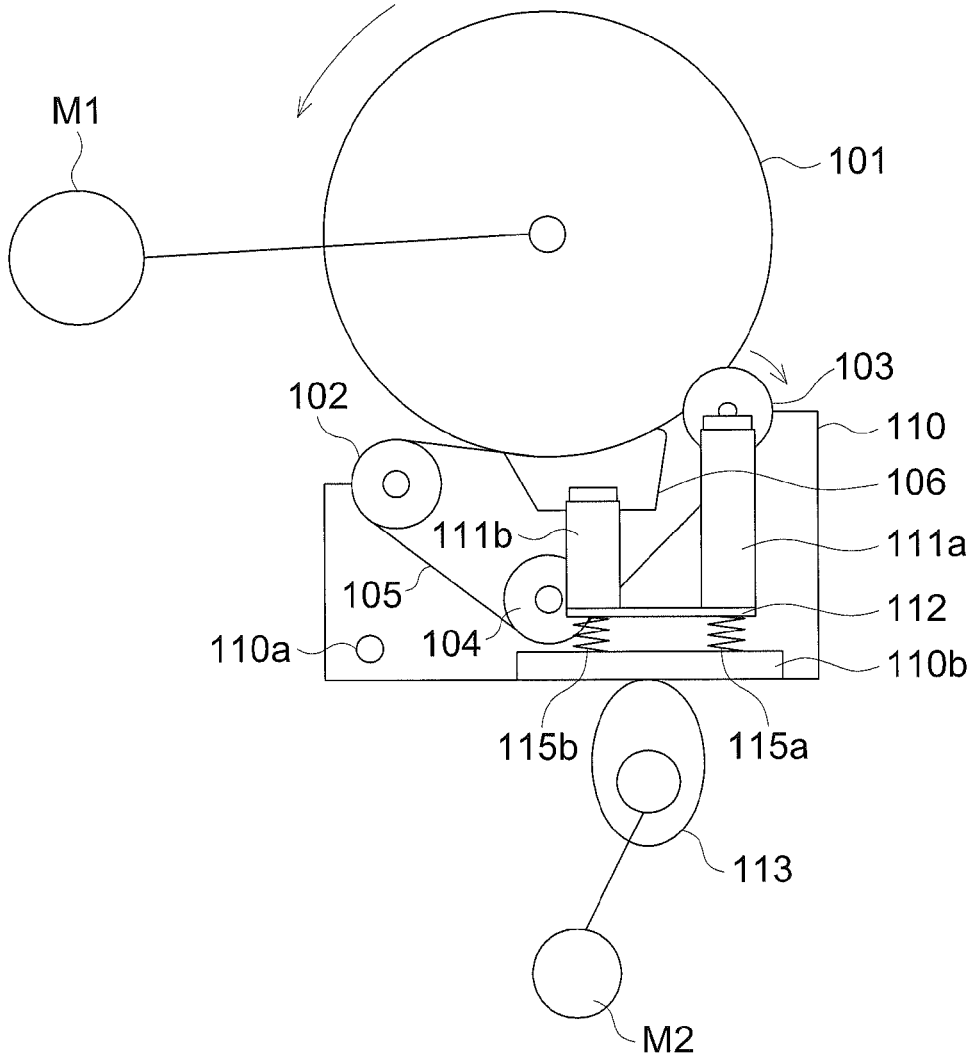

FIG. 12 is a diagram showing a drive mechanism of a fixing apparatus.

Figure 13A:
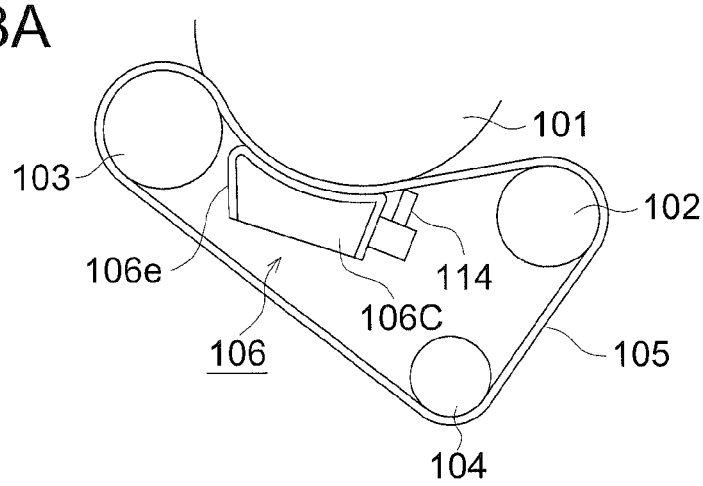
Figure 13B:
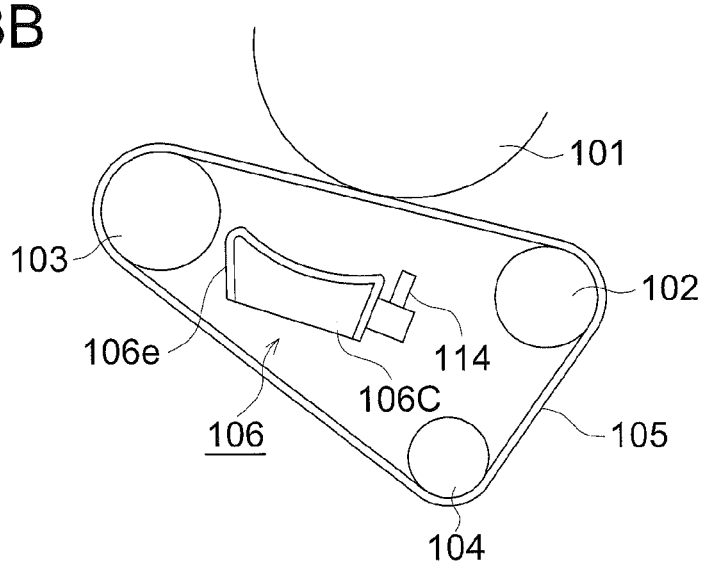
Figure 13C:
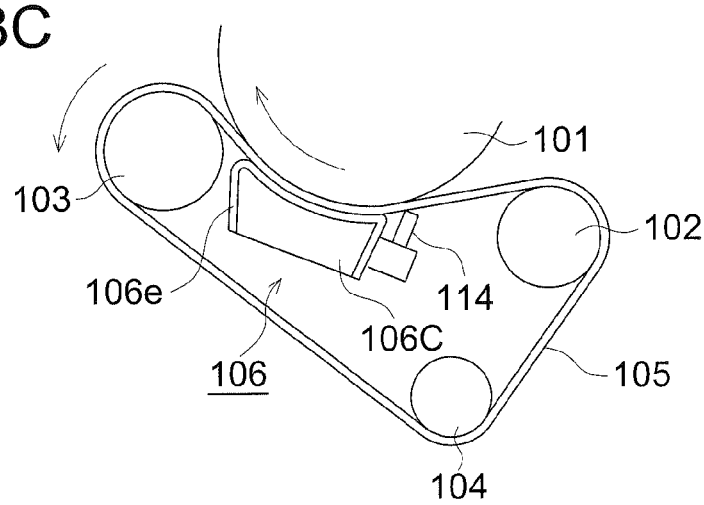

Each of FIGS. 13A-13C is a diagram showing the state of a fixing apparatus in the occasions of a fixing process, a pause and of coating of lubricant.

Figure 14:
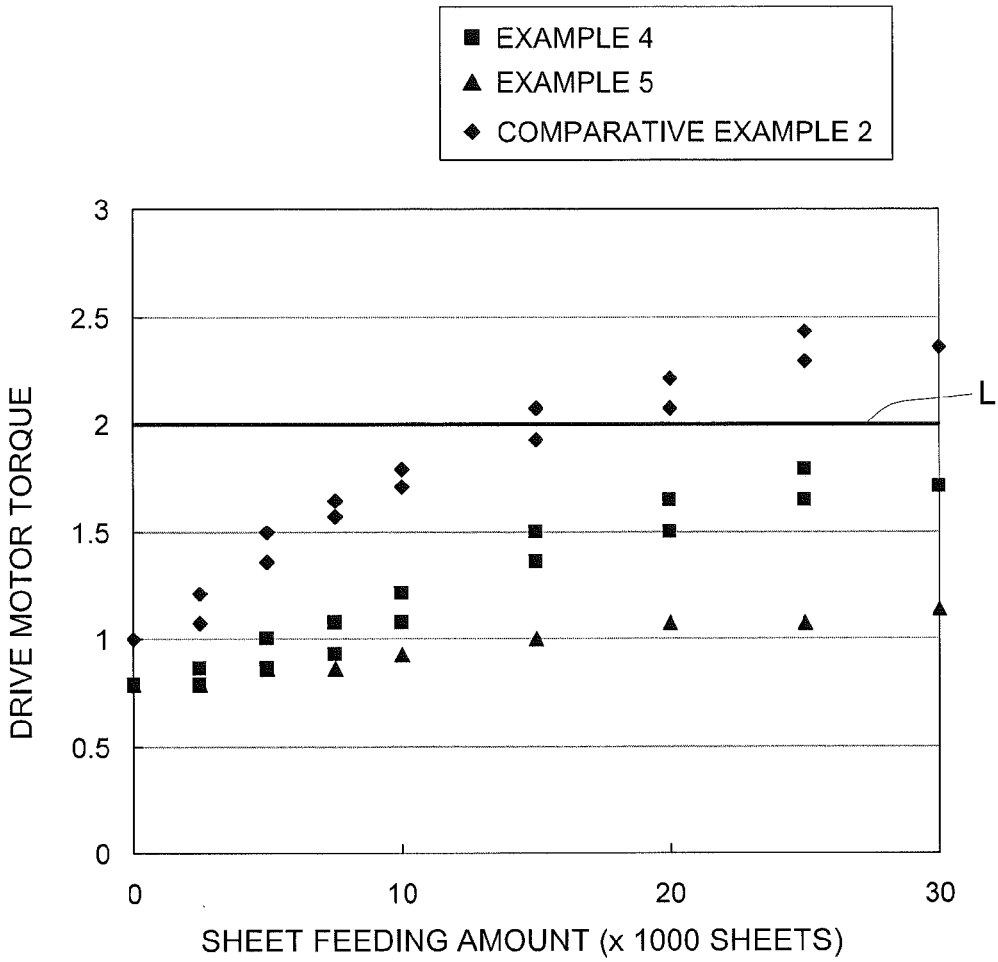

FIG. 14 is a graph showing changes of drive torque for a fixing belt.

DETAILED DESCRIPTION OF THE PREFERRED EMBODIMENT

The invention will be explained as follows, based on the embodiment, to which, however, the invention is not limited.

Figure 1:
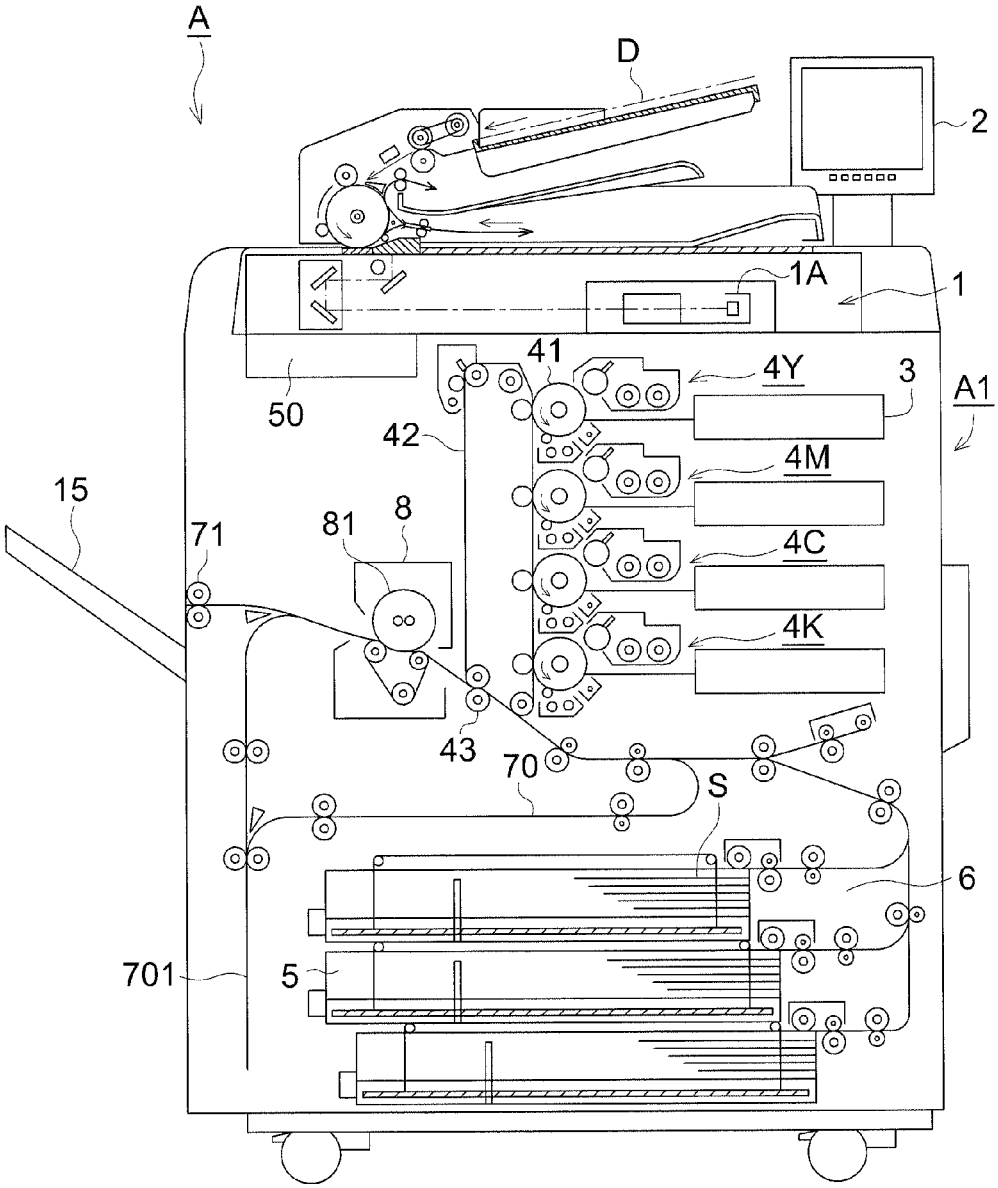
FIG. 1 is a central cross-sectional view of an image forming apparatus relating to the present embodiment.

FIG. 1 is a central cross-sectional view of an image forming apparatus relating to the present embodiment. Image forming apparatus A is one that is called a color image forming apparatus of a tandem type, and it has control section 50, image forming section A1, scanner section 1, operation and display section 2 and automatic document feeder D. The control section 50 is equipped with CPU and with a memory to control respective sections of the image forming apparatus A.

The image forming section A1 has therein plural sets of image forming sections for 4Y (yellow), 4M (magenta), 4C (cyan) and 4K (black), image writing sections 3 (reference symbols are omitted for M, C and K), intermediate transfer belt 42, sheet feeding cassette 5, sheet feeding section 6, sheet ejection section 71, fixing apparatus 8 and two-sided conveyance path 70. The fixing apparatus 8 will be described in detail later.

Each of image preparing sections 4 (4Y, 4M, 4C and 4K) has a developing section which contains two-component developer composed of a small particle size toner for each of respective colors of yellow (Y), magenta (M), cyan (C) and black (k) and of carrier.

On the upper portion of image forming apparatus A, there is mounted automatic document feeder D. A document placed on a platen of the automatic document feeder D is conveyed in the direction of an arrow, and images on one side or images on both sides of the document are read by an optical system of scanner section 1, to be loaded in CCD image sensor 1A.

Analog signals which have been subjected to photoelectric conversion by CCD image sensor 1A are subjected, in control section 50, to analog processing, A/D conversion, shading correction and image compression processing, and their signals are sent to image writing section 3.

In the image writing section 3, photoreceptor drum 41 (reference symbols are omitted for M, C and K) is illuminated by light emitted from a semiconductor laser, and latent images are formed. In the image preparing section 4, processes of charging, exposure, developing, transfer, separation and cleaning are carried out. Toner images for respective colors formed on the image preparing section 4 are transferred onto the rotating intermediate transfer belt 42 one after another by a primary transfer section, thus, composite color images are formed.

Toner images on the intermediate transfer belt 42 are transferred onto sheet S conveyed from sheet feeding cassette 5 by sheet feeding conveyance section 6. The sheet S carrying toner images is heated by fixing apparatus 8 to be fixed by pressure, and is ejected from sheet ejection section 7 to the outside of the apparatus to be placed on sheet ejection tray 15.

When forming images on both sides of a sheet, sheet S on which an image has been formed on the first surface (the obverse) of the sheet S and has been fixed by the fixing apparatus 8 is conveyed to conveyance path for two-sided copying 70 to be reversed inside out by switchback path 701, and the sheet S is conveyed again to image preparing sections 4 where an image is formed on the second surface (the reverse) of the sheet S that is ejected to the outside of the apparatus by sheet ejection 71 to be placed on sheet ejection tray 15.

Operation and display section 2 is composed of a liquid crystal display section and of a touch panel section that is arranged to be superimposed on the liquid crystal display section, and it displays information of an image forming apparatus to an operator and instructions from the operator are inputted in it.

Fixing Apparatus

Figure 2:
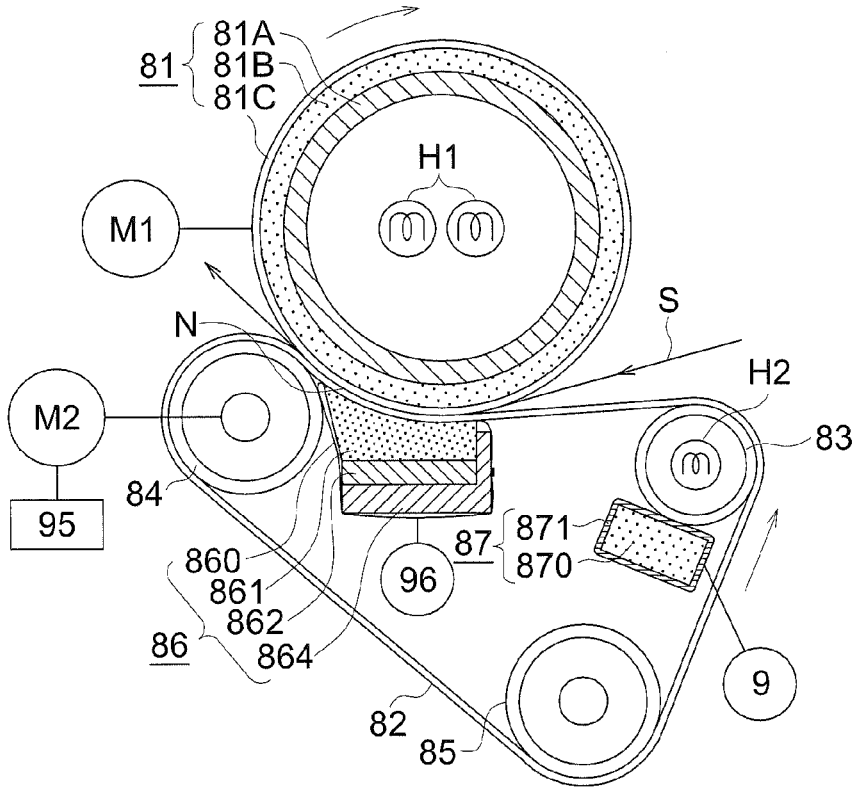
FIG. 2 is a central cross-sectional view of fixing apparatus 8 of a type of a fixing belt.

Next, main construction of fixing apparatus 8 of a belt-nip type relating to the embodiment will be explained as follows. FIG. 2 is a central cross-sectional view of fixing apparatus 8 of a fixing-belt type.

In the fixing apparatus 8, a toner image on the sheet S is heated and pressed to be fixed on fixing-nip section N formed between heating roller 81 (which is also called a fixing roller) heated by heater H1 composed of a halogen heater and fixing belt 82. In this case, heating roller 81 and heater H1 function as a heating section, and fixing belt 82 and plural rollers about which a fixing belt is trained function as a pressurizing section.

Heating roller 81 has therein heater H1 serving as a heating source built-in, and it is composed of cylindrical core 81A that is made of aluminum or steel, elastic layer 81B that covers the cylindrical core 81A and is made of HTV silicon rubber whose heat resistance is high and of mold releasing layer 81C that further covers the elastic layer 81B and is made of fluoric resin such as PFA (perfluoro alkyl vinyl ether) or of PTFE (polytetra-fluoroethylene).

Fixing belt 82 is composed of a substrate formed with a heat resistant elastic resin such as polyimide having a thickness of 70 μm, an elastic layer such as silicon rubber layer having a thickness of 200 μm that covers an outer surface of the substrate and of the mold releasing layer that further covers the aforesaid elastic layer and is made of PFA or PTFE having a thickness of 30 μm, and it is formed to be endless.

The fixing belt 82 is trained about roller 83 that is close to an introducing section for sheet S, pressurizing roller 84 on the exit side for sheet S and supporting roller 85, and it comes in contact with an outer circumferential surface of heating roller 81. The pressurizing roller 84 is located to be close to the downstream side in the sheet conveyance direction (rotational direction) of pressure applying section 86, and it causes the fixing belt 82 to contact the heating roller 81 with pressure, together with the pressure applying section 86, to form fixing nip section N. With respect to the fixing nip section N, its length is 20 mm (in the direction of sheet conveyance) and its width is 340 mm (in the direction of roller axis), for example.

The roller 83 functions as "a heating roller" that touches the fixing belt 82 internally and has heater H2 built-in. The heater H2 is controlled by control section 50 to be at prescribed temperature under an output of an unillustrated temperature sensor. Further, lubricant supplying member 87 that is described later is in contact with the roller 83, and lubricants are supplied to an inner circumferential surface of the fixing belt 82 through the roller the roller 83. The roller 85 is a roller that is also called a steering roller, and it corrects skewing of the fixing belt by inclining an axis of the roller 85 by swinging one end of the axis.

Pressure Applying Section 86

The pressure applying section 86 that applies pressure from the inside is arranged to be in the vicinity of the upstream side for the pressurizing roller 84 among rollers 83, 84 and 85 about which the fixing belt 82 is trained, and the pressurizing roller 84 and the fixing belt 82 are caused to touch heating roller 81 with pressure, to form fixing nip section N. The pressure applying section 86 is composed of pressing pad 861, holding member 862 that holds the pressing pad 861, holder 864 that fixes the holding member 862 and is held in terms of both end portions by an unillustrated supporting member, and of sliding sheet 860 that covers the pressing pad 861 and slides on an inner circumferential surface of the fixing belt 82.

The pressing pad 861 is formed by heat resistant rubber, such as silicon rubber with hardness of JISA 10°-30°, on the holding member 862 to be in a shape following a curved surface of the heating roller 81. The holding member 862 is made of, for example, stainless steel. The sliding sheet is made of heat resistant resin such as, for example, polyimide having a thickness of 70 μm, for example, and it is subjected to emboss molding to provide a concavoconvex form, an area to contact with the fixing belt 82 is made to be small, and low friction is achieved. The holder 864 is made of stainless steel. The sliding sheet 860 covers the pressing pad 861 and is fixed on the holder 864.

Lubricant Supplying Member 87

Lubricant supplying member 87 that supplies lubricants is arranged on the inner circumferential surface side of the fixing belt 82. Incidentally, though lubricants are supplied to the inner circumferential surface side of the fixing belt 82 through roller 83 in the example shown in FIG. 2, it is also possible to supply (coat) lubricants directly by causing the lubricant supplying member 87 to touch the fixing belt 82.

The lubricant supplying member 87 is composed of oil impregnating member 870 and of oil regulating film 871. The oil impregnating member 870 is made of felt such as alamido fiber to be surrounded by the oil regulating film 871 wherein PTFE porous film is formed to be a bag. The porosity of the oil regulating film 871 is about 30%-80%. Lubricants are impregnated in oil impregnating member 870 in advance. A lubricant reservoir tank stores lubricants, and it supplies lubricants from a porous film of the oil regulating film 871. As a lubricant, silicon oil such as dimethyl silicon oil having a degree of viscosity of 100-1000 cs, or methyl phenyl silicon oil having a degree of viscosity of 100-1000 cs can be used.

It is possible to release pressure contact of pressure applying section 86 against heating roller 81 by pressure contact releasing section 9*b*. Pressing force change section 9 changes contact pressure of the lubricant supplying member 87 against roller 83. Further, the pressing force change section 9 functions as a supplying amount change section. Details will be explained later.

In the fixing apparatus 8 constructed in the aforesaid way, heating roller 81 that is heated by heater H1 and is driven by motor M1 rotates clockwise in the illustration. Pressurizing roller 84 on the exit side is driven by motor M2 to rotate counterclockwise. In the case of pressure contact, the fixing belt 82 is subjected to driven rotation by heating roller 81, and concurrently is subjected to drive rotation by pressurizing roller 84. In the case of releasing, the fixing belt 82 is subjected to drive rotation by pressurizing roller 84. Rollers 83 and 85 are subjected to driven rotation by rotation of the fixing belt 82. Drive current measuring section 95 is connected to motor M1 and motor M2, which makes it possible to measure drive torque of motor M1 and to measure drive torque of motor M2.

Pressing pad 861 is pressed by compression spring through holder 864 and holding member 862, and the pressing pad 861 presses the fixing belt 82 against the heating roller 81 by compression spring through holder 864 and holding member 862. Pressurizing roller also 84 presses the fixing belt 82 against the heating roller 81 with the compression spring, through a supporting member that supports with its end portion the pressurizing roller 84. Based on the construction mentioned above, fixing nip portion N having a broad width is formed on the space between pressurizing section 80 and heating roller 81. The fixing belt 82 is caused by drive rotation of the heating roller 81 and of the pressurizing roller to rotate counterclockwise. Unfixed toner on the sheet S conveyed is heated and pressurized on the fixing nip portion N to be fixed.

Figure 3:
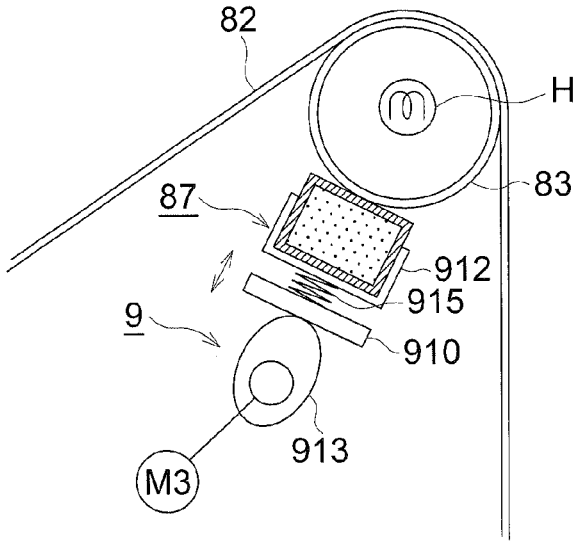
FIG. 3 is a schematic diagram that illustrates construction of pressing force change section 9.

FIG. 3 is a schematic diagram that illustrates construction of pressing force change section 9. The pressing force change section 9 is composed of drive motor M3, cam 913, supporting plate 910, sprint 915, and of supporting frame 912. The drive motor M3 is composed of a stepping motor and is capable of controlling an amount of rotation. When drive motor M3 is controlled by control section 50, the supporting plate 910 is moved in the direction of an illustrated arrow by causing cam 913 to rotate for prescribed number of rotations. By moving the supporting plate 910, contact pressure (pressing force) of lubricant supplying member 87 against roller 83 can be changed by spring 915. When a load for contact is increased, density of felt of oil impregnating member 870 grows to be higher, and lubricants are pushed out from a face. Therefore, it is possible to reduce a supplying amount of lubricants by increasing a supplying amount of lubricants by the lubricant supplying member 87 and by reducing contact pressure. Further, the construction of pressure contact releasing section 9*b* is the same as that of pressing force change section 9 shown in FIG. 3, and pressure applying section 86 is moved downward (FIG. 2) by rotating the cam with an unillustrated drive motor by a prescribed amount of rotations, and pressure contact of the fixing belt 82 is changed to the state of releasing.

Figure 4:
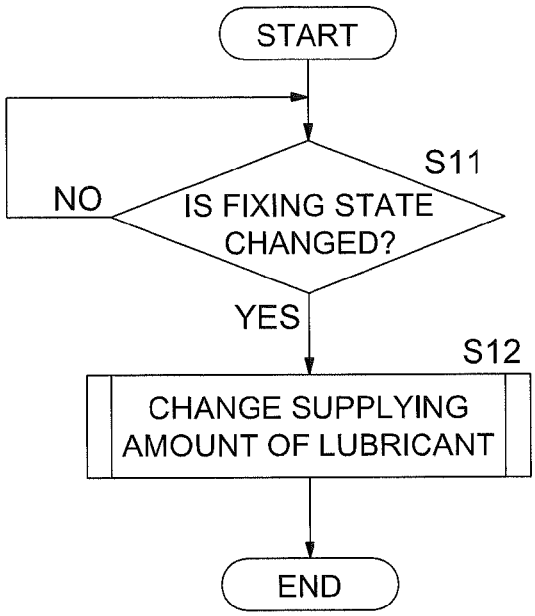
FIG. 4 is an illustration diagram for a control flow that is followed by control section 50.

FIG. 4 is a control flow that is conducted by control section 50 of an image forming apparatus. As is shown in FIG. 4, when a change of the state of fixing is detected (step S11), an appropriate supplying amount of lubricants for fixing belt 82 is calculated depending on that state of fixing, and the supplying amount of lubricants is changed so that it may become the appropriate supplying amount (step S12). The change of the state of fixing and the change of the supplying amount of lubricants will be explained in detail as follows.

Change of the State of Fixing

The change of the state of fixing means a change of the state by which resistances of sliding between an inner circumferential surface of the fixing belt 82 and pressing section 86 are affected.

For example, contents of the change of the state of fixing include (1) replacement of parts of fixing belt 82, pressing section 86 and lubricant supplying member 87, or quantity consumed based on the aforesaid parts replacement and (2) an intermission period counted from interruption of operation of a fixing apparatus. The quantity consumed in this case means operating time of fixing apparatus 8 or the number of sheets which have passed through the fixing apparatus 8. The operation means a situation wherein electric power is supplied to each of heaters H1 and H2 of the fixing apparatus 8 for heating and controlling, or a situation wherein rotary drive is working together with heating and controlling.

With respect to the aforesaid (1), an amount of sticking of lubricants on an inner circumferential surface of the fixing apparatus goes short initially immediately after replacement of fixing belt 82 to a fresh one because no lubricant is sticking to an inner circumferential surface of the fixing belt 82, resulting in an increase of resistance for sliding on pressing section 86. Further, the pressing section 86 also meets with the same situation immediately after it is replaced, because no lubricant is sticking to sliding sheet 860. On the other hand, with respect to the lubricant supplying member 87, lubricants in sufficient amount are impregnated in it immediately after replacement thereof, and the lubricants decrease gradually as quantity consumed increases. With a decrease in an amount of impregnation of lubricants, a supplying amount of lubricants decreases gradually even under the condition of the same pressure of contact.

With respect to the aforesaid (2), when a length of an intermission period counted from interruption of operation is longer than a prescribed period of time, sliding resistance increases. On an inner circumferential surface of the fixing belt 82, there is formed a lubricant film representing a thin layer of lubricant which is relatively stable under a condition of the state of operation. However, when the fixing apparatus is left for a long time under the condition of interruption, it is considered that the state of the lubricant film is changed greatly, and the coefficient of friction is enhanced.

Further, in (3), it is also possible to arrange so that increase and decrease of sliding resistance may be detected directly by an output of a drive current measuring section 95. Table 1 is one wherein relationship between changes of these fixing states and sliding resistances is shown in a tabulated list.

TABLE 1

| Sliding resistance | Replaced parts: Fixing belt 82 | Pressure applying member 86 | Lubricant supplying section 87 | Intermission period | Drive current |
|---|---|---|---|---|---|
| High | Fresh part | Fresh part | Used part | Not less than prescribed value | Large |
| Low | Used part | Used part | Fresh part | Not more than prescribed value | Small |

Change in Supplying Amount Of Lubricant

Next, changes of supplying amount of lubricants will be explained. Concerning the change of supplying amount of lubricants, it is possible to conduct it by increasing or decreasing pressure of contact of lubricant supplying member 87 against roller 83 with pressing force change section 9 that functions as a supplying amount change section shown in FIG. 3.

Figure 5:
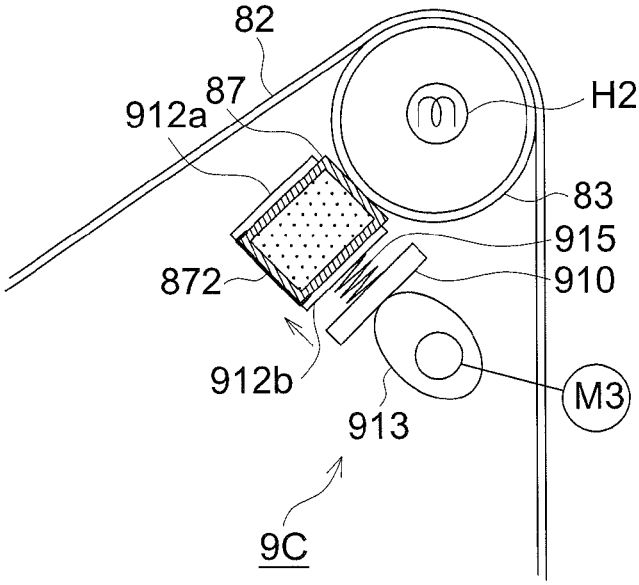
FIG. 5 is an example of variation for pressing force change section relating to the second Example.

Next, the second embodiment representing a supplying amount change section will be explained as follows. FIG. 5 is an example of a variation for contact pressure change section relating to the second embodiment. Due to displacement of supporting plate 912*b* caused by pressing force change section 9*c*, a distance from the fixed supporting plate 912*a* is changed. By narrowing a distance between the supporting plate 912*a* and the supporting plate 912*b*, it is possible to increase an amount of supplying from the lubricant supplying member 87, and by making a length of the aforesaid distance to be longer, it is possible to decrease a supplying amount. Heat resistant and oil-proof sheet 872 that does not transmit lubricant is provided on the side that is opposite to roller 83 of the lubricant supplying member 87.

FIG. 6 shows an example of a supplying amount change section relating to the third embodiment. In the example shown in FIG. 6, a supplying amount is changed by changing contact width "n" between the roller 83 and the lubricant supplying member 87.

Supporting frame 912 is fixed on stay 918, and makes a change of a supplying amount of lubricants by increasing or decreasing contact width "n" by rotating stay 918 with rotation drive section 9*d*. FIG. 6*a* is a diagram showing the first state and FIG. 6*b* is a diagram showing the second state that is rotated from the first state. Compared with the first state, contact width "n" is broader and a supplying amount for lubricants is more in the second state.

FIG. 7 is an example of a supplying amount change section relating to the fourth embodiment. In the example shown in FIG. 7, a lubricant supplying member is composed of two items including the first lubricant supplying member 87*a* and the second lubricant supplying member 87*b*. Supplying amount of lubricant for the first lubricant supplying member 87*a* is different from that for the second lubricant supplying member 87*b*. For example, the porosity of the oil regulating film of the first lubricant supplying member 87*a* is 50% and the porosity of the oil regulating film of the second lubricant supplying member 87*b* is 70%, and a supplying amount for the first lubricant supplying member 87*a* is more than that for the second lubricant supplying member 87*b*.

The first lubricant supplying member 87*a* and the second lubricant supplying member 87*b* are fixed on the same stay 919, and it is possible to switch lubricant supplying members touching roller 83 by rotating the stay 919 on the center of axis 920 with rotation drive section 9*e*. In other words, it is possible to switch lubricant supplying members to be used.

A supplying amount change section relating to the fifth embodiment will be explained as follows, next. As is shown in FIG. 3, heater H2 is built in roller 83 with which the lubricant supplying member 87 contacts, and the heater H2 is controlled by control section 50. When controlled temperature of the heater H2 is changed, an amount of supplying lubricants can be changed, because a temperature of lubricant supplying member that is in contact with heater H2 is changed. For example, when changes are made within a range of control temperatures 100° C.-160° C., the higher the control temperature is, the higher the temperature of lubricants of lubricant supplying member 87 grows, thus, a degree of viscosity of the lubricant is lowered, resulting in possibility of an increase of a supplying amount of lubricants. As explained above, the control section 50 and the heater H2 function as a supplying amount change section in the present embodiment.

Table 2 is one wherein relationship between changes of these fixing states and sliding resistances is shown in a tabulated list.

TABLE 2

| Sliding amount of lubricant | Contact load | Nip width | Lubricant supplying member 87 | Heater H2 controlled temperature |
|---|---|---|---|---|
| Large | Load high | Broad | Second lubricant supplying member | Temperature high |
| Small | Load low | Narrow | First lubricant supplying member | Temperature low |

Lubricant Coating Process

FIG. 8 is an illustration of a control flow concerning lubricant coating process that is carried out by control section 50. The example shown in FIG. 8 is a control flow to be carried out when sliding resistance between the fixing belt 82 and pressure applying section 86 is judged to be high by a change of the state of fixing, and a change of a supplying amount is made so that the amount of supplying lubricants may be increased. In this case, the sliding resistance keeps to be high until the moment when lubricants are supplied to the entire surface on an inner circumferential surface of the fixing belt 82, therefore, the control flow is one to prevent troubles caused by the high sliding resistance for the period when the sliding resistance is high. In addition, when the fixing belt 82 and the pressure applying section 86 are in pressure contact each other, a lubricant film is hardly formed on the surface of the fixing belt 82. Therefore, it is preferable to release the pressure contact (to separate the pressure applying section 86 from the fixing belt 82), because the lubricant film is formed promptly. In particular, when the fixing belt 82 is replaced with a fresh one, the sliding resistance is increased initially. Therefore, the occasion of this kind is suitable for application of the control shown in FIG. 8.

In step S21 in FIG. 8, an amount of coating lubricants is increased. In the following explanation of the example, pressing force change section 9 is used as a supplying amount change section. However, this can also be applied to the second embodiment to the fifth embodiment. In the fifth embodiment, in particular, the control in FIG. 8 can be applied preferably, because a temperature of roller 83 can be changed without considering fixing property for sheets.

In succeeding step S22, the state of pressure contact of pressure applying section 86 against the fixing belt 82 is changed to the released state. Releasing is carried out by pressure contact releasing section 9*b* shown in FIG. 2. Under this condition, the sliding resistance between the pressure applying section 86 and the fixing belt 82 is eliminated.

In step S23, idling is conducted under this condition. The idling is carried out for about two minutes at a speed representing a linear speed of 270 mm/s of fixing belt 82. Owing to this idling, lubricants in sufficient quantities can be supplied to an inner circumferential surface of the fixing belt 82.

In steps S24 and S25, steps are terminated after returning an amount of coating of lubricants and the state of pressure contact to their original states in the post-treatment processing.

In the present embodiment, it is possible to optimize an amount of supplying lubricants to the fixing belt by changing a supplying amount of lubricants, and further to reduce sliding resistance and to prevent contamination of a sheet by lubricants, by detecting a change of the state of fixing with control section 50 and by changing a supplying amount of lubricants.

Meanwhile, it is also possible to use one wherein the first to fifth embodiments are combined mutually, as a device to change a supplying amount.

Though control section 50 controls pressing force change sections 9 and 9*c* as well as rotation drive sections 9*d* and 9*e* which function as a supply amount change section by detecting a change of the state of fixing in the embodiments shown in FIG. 1-FIG. 8, it is also possible to construct so that these supplying amount change sections may be operated by an operator. In that case, the control section 50 judges whether to increase or to decrease a supplying amount of lubricants based on a quantity consumed from parts replacement as changes of the state of fixing, and thereby to cause the results of the judgment to be displayed on the operation and display section 2. Then, an operator operates the supplying amount change section manually.

Further, though the pressurizing section is of the structure wherein a fixing belt, a pressure applying member and a lubricant supplying member are provided on the pressurizing section, in the embodiments shown in FIGS. 1-8, it is possible to arrange a structure wherein the pressurizing section is made to be a roller, and a fixing belt, a pressure applying member and a lubricant supplying member are provided on the heating section. It is further possible to arrange a structure wherein a fixing belt, a pressure applying member and a lubricant supplying member are provided on each of the pressurizing section and the heating section.

Examples

Basic constructions are those shown in FIGS. 1-3, and respective conditions are as follows.

Conditions (Fixing Apparatus 8)

Heating Roller 81:

Outer diameter 65 mm,

Silicon rubber layer with thickness of 1.5 mm and PFA surface layer with thickness of 30 μm on core metal with thickness of 5 mm made of aluminum Pressurizing Roller 84:

Outer diameter 23 mm,

Metal bar made of stainless steel

Fixing Belt 82:

Silicon rubber layer with thickness of 200 μm and PFE layer with thickness of 30 μm on PI with thickness of 70 μm Pressure Applying Member 86:

Silicon rubber layer with thickness of 3 mm and with hardness of JISA20° on an aluminum base plate Sliding Sheet 860:

Embossed PI sheet (Lubricant Supplying Member 87)

Oil Impregnating Member 870:

Alamido fiber felt (t6 mm×w15 mm×L340 mm) Basis weight 1300 (g/m$^2$)

Oil Regulating Film 871:

PTFE porous film porosity 50%

Lubricant:

Dimethyl silicon oil viscosity 300 cs (Process Conditions)

Sheet

Plain paper (Basis weight 80 g/m$^2$), A4 size, transverse feed)

Sheet Feeding Speed:

65 sheets/minute

TABLE 3

| | Coating process | Contact pressure N | Contact width n mm | Roller 83 control temperature (in coating process) ° C. |
|---|---|---|---|---|
| Example 1 | Existing for 2 minutes | 4.90 | 3.0 | 100 |
| Example 2 | Existing for 2 minutes | 1.96 | 9.0 | 100 |
| Example 3 | Existing for 2 minutes | 1.96 | 3.0 | 160 |
| Comparative Example 1 | Nonexistent | 1.96 | 3.0 | 100 |

Table 3 shows contents of supplying amount change sections in Examples 1 to 3. In Example 1, a supplying amount of lubricants is increased by increasing contact pressure by pressing force change section 9, in Example 2, a supplying amount of lubricants is increased by increasing contact width "n" by rotation drive section 9*d* and in Example 3, a supplying amount of lubricants is increased by enhancing controlled temperature of roller 83. In Examples 1 to 3, lubricants are supplied by changing to contents of supplying amount change section in Table 3 for the period for lubricant coating process for two minutes shown in FIG. 8, for the change of the state of fixing described later. After the lubricant coating processing is terminated, the conditions are returned to those which are the same as those in the Comparative Example 1, to conduct sheet feeding. In the Comparative Example 1, lubricant coating processing is not carried out, and coating conditions for lubricants remain the same to be fixed.

Test 1

The change of the state of fixing means "replacement of fixing apparatus 8 to a fresh one". In the case of this replacement, at least fixing belt 82, pressure applying member 86 and lubricant supplying member 87 are replaced to fresh ones.

Results of the Test 1 are shown in Table 4. The Table 4 is one showing transitions of drive torque of fixing apparatus 8 for quantity consumed counted from the moment of replacement to fresh items (measured values by drive current measuring section 95), and it indicates proportion values wherein the measured value in Example 1 at the starting point is 1.0.

In Examples 1 to 3, a lubricant coating process is carried out for two minutes under the conditions in Table 3 immediately after replacement to fresh items, and then, the conditions are changed to be the same as those in the Comparative Example 1, to conduct sheet feeding.

As is shown in Table 4, drive torque immediately after the start of sheet feeding by a fresh fixing apparatus 8 is high in Comparative Example 1, while, in Examples 1 to 3, drive torque is low from the moment immediately after the start of sheet feeding. Further, in Examples 1 to 3, troubles such as displacement of lubricants to a sheet caused by an excessive supply of lubricants did not happen.

TABLE 4

| | Quantity consumed (number of sheets fed) | | | | | |
|---|---|---|---|---|---|---|
| | 10 | 50 | 100 | 1000 | 10000 | 50000 |
| Example 1 | 1.0 | 1.0 | 1.0 | 1.0 | 1.1 | 1.1 |
| Example 2 | 1.0 | 1.0 | 1.0 | 1.0 | 1.1 | 1.1 |
| Example 3 | 1.0 | 1.0 | 1.0 | 1.0 | 1.1 | 1.1 |
| Comparative Example 1 | 1.5 | 1.4 | 1.3 | 1.1 | 1.2 | 1.2 |

Test 2

The change of the state of fixing means an occasion "when an intermission period from a stop of operation of a fixing apparatus exceeds a prescribed period of time". The prescribed period of time in Examples 1 to 3 is set to 8 hours which corresponds roughly to an overnight intermission period. In the Examples 1 to 3, when the intermission period of time exceeds consecutive 8 hours, lubricant coating process is carried out for two hours under the conditions shown in Table 3. After that conditions are changed to be the same as those in Comparative Example 1, to feed sheets.

Results of the Test 2 are shown in Table 5. The Table 5 is one showing transitions of drive torque of fixing apparatus 8 for the number of fed sheets after the pause for more than 8 hours (measured values by drive current measuring section 95), and it indicates proportion values wherein the measured value in Example 1 at the starting point is 1.0.

As is shown in Table 5, drive torque immediately after the start of sheet feeding after a pause for a ling time is high in Comparative Example 1, but in Examples 1 to 3, the drive torque is low from the moment immediately after the start of sheet feeding. Further, in Examples 1 to 3, troubles such as displacement of lubricants to a sheet caused by an excessive supply of lubricants did not happen.

TABLE 5

| | Quantity consumed (number of sheets fed) | | | | | |
|---|---|---|---|---|---|---|
| | 10 | 100 | 500 | 1000 | 2000 | 5000 |
| Example 1 | 1.0 | 1.0 | 1.0 | 1.0 | 1.0 | 1.0 |
| Example 2 | 1.0 | 1.0 | 1.0 | 1.0 | 1.0 | 1.0 |
| Example 3 | 1.0 | 1.0 | 1.0 | 1.0 | 1.0 | 1.0 |
| Comparative Example 1 | 1.3 | 1.2 | 1.2 | 1.1 | 1.1 | 1.0 |

FIG. 9 shows a color image forming apparatus employing a fixing apparatus relating to another embodiment of the invention. The color image forming apparatus shown in FIG. 9 is one called a color image forming apparatus of a tandem type wherein toner images formed on photoreceptors are transferred onto an intermediate transfer member to be superimposed, and toner images thus superimposed are transferred onto a recording material collectively, and it is composed of image reading section SC and of image forming section A, and it has therein plural sets of image forming units 210Y, 210M, 210C and 210K, intermediate transfer unit 207, a sheet feeding conveyance unit and fixing apparatus 100.

The image forming unit 210Y that forms an image of a yellow color has photoreceptor 201Y and has charging device 202Y, exposure device 203Y, developing device 204Y, primary transfer device 205Y and cleaning device 206Y which are arranged to surround the photoreceptor 201Y. The image forming unit 210M that forms an image of a magenta color has photoreceptor 201 and has charging device 202M, exposure device 203M, developing device 204M, primary transfer device 205M and cleaning device 206M which are arranged to surround the photoreceptor 201M. The image forming unit 210C that forms an image of a cyan color has photoreceptor 201C and has charging device 202C, exposure device 203C, developing device 204C, primary transfer device 205C and cleaning device 206C which are arranged to surround the photoreceptor 201C. The image forming unit 210K that forms an image of a black color has photoreceptor 201K and has charging device 202K, exposure device 203K, developing device 204K, primary transfer device 205K and cleaning device 206K which are arranged to surround the photoreceptor 201K. In each image forming unit, charging, exposure and developing are carried out, and toner images for respective colors are formed on respective photoreceptors.

Intermediate transfer unit 207 has intermediate transfer body 270 in a shape of a semiconductor endless belt that is trained about plural rollers and is supported to be rotatable.

Toner images in respective colors formed respectively by image forming units 210Y, 210M, 210C and 210K are transferred by primary transfer devices 205Y, 205M, 205C and 205K onto rotating intermediate transfer bodies 270 to be superimposed one after another, thus, a composite color toner image is formed. Recording material P stored in sheet-feeding cassette 220 is fed by sheet-feeding device 221, and passes through plural intermediate rollers 222A, 222B, 222C and 222D and registration roller 223 to be conveyed to secondary transfer device 205A, thus, color toner images superimposed on the recording material P are collectively transferred. The recording material P onto which the color toner images have been transferred is subjected to fixing process by fixing apparatus 100, and is interposed by sheet-ejection roller 225 to be placed on sheet-ejection tray 226 located to be outside the apparatus.

On the other hand, after the color toner image is transferred on the recording material P by secondary transfer device 205A, remaining toner on the intermediate transfer member 270 from which the recording material P has been separated by curvature is removed by cleaning device 206A.

In the course of image forming processing, the primary transfer device 205K is in pressure contact with photoreceptor 201K constantly. Each of other primary transfer devices 205Y, 205M and 205C comes in pressure contact with each of corresponding photoreceptors 201Y, 201M and 201C only when a color image is formed.

Secondary transfer device 205A comes in pressure contact with intermediate transfer member 270, only when the recording material P passes through this place and secondary transfer is carried out.

As a fixing apparatus for fixing a toner image, there is used fixing apparatus 100 of a belt fixing type wherein a recording material is interposed and conveyed by a fixing belt and a fixing member, and a toner image is heated while it is interposed and conveyed to be fixed on the recording material.

Each of FIGS. 10A-10B is a diagram that shows the construction of fixing apparatus 100 relating to other embodiments.

Fixing apparatus 100 has fixing roller 101 representing a fixing member that heats a toner image to fix it and has fixing belt 105 that interposes recording material P together with the fixing roller 101 to convey the recording material P.

The fixing roller 101 is composed of core metal 101*a* representing a pipe made of stainless steel, elastic layer 101*b* that is formed on the core metal 101*a* and is made of silicon rubber and of an unillustrated releasing superficial layer that is formed on the elastic layer 101*b* and is made of PFA.

As is shown in FIG. 10B, the fixing belt 105 is composed of base layer 105*a* that is made of PI (polyimide), elastic layer 105*b* that is formed on the base layer 105*a* and is made of silicon rubber and of superficial layer 105*c* that is formed on the elastic layer 105*b* and is made of PFA. The superficial layer 105*c* comes in contact with recording material P.

The fixing belt 105 is trained about entrance roller 102, separation roller 103 and steering roller 104.

Each of the entrance roller 102, separation roller 103 and steering roller 104 is made of SUS standing for stainless steel. As is illustrated, each of the separation roller 103 and the steering roller 104 is a rod-like member that is not hollow, while, the entrance roller 102 is a pipe-shaped member in which heater 107 is provided to heat fixing belt 105. The separation roller 103 presses the fixing belt 105 against the fixing roller 101 so that the elastic layer 101*b* may be deformed to dig into the fixing roller 101.

Under the fixing roller 101, pressure applying member 106 presses the fixing belt 105 against the fixing roller 101 so that fixing nip N may be formed by the pressure applying member 106 and the separation roller 103.

The pressure applying member 106 is composed of supporting member 106*a*, spacer 106*b*, pressing pad 106*c*, base member 106*d* and of sliding member 106*e*. The pressing pad 106*c* is made of elastic body such as silicon rubber, and is covered by sliding member 106*e* that is made of PI sheet, as is shown in FIG. 11. A portion where the pressing pad 106*c* comes in contact with the fixing roller 101 is formed to be in a form that is curved to agree with an outer circumference of the fixing roller 101, as is illustrated. The base member 106*d* is made of aluminum, and it is formed to be united with the pressing pad 106*c*, in the case of molding.

The fixing roller 101 and the separation roller 103 are connected to each other by a power transmission mechanism, and they are rotated by drive of a motor (not shown) serving as a drive device. When the fixing belt 105 is pressed by the fixing roller 101, the fixing belt 105 is driven by the fixing roller 101, and is driven also by separation roller 103. When the fixing belt 105 is not pressed, the fixing belt 105 is driven by only separation roller 103 to rotate. The entrance roller 102 and the steering roller 104 are driven by the fixing belt 105 to rotate.

The numeral 108 represents a heater composed of a halogen lamp, and it heats the fixing roller 101, and a toner image is fixed by fixing roller 101 heated by the heater 108.

In the case of image forming, recording material P is introduced as shown with arrow W1 into fixing apparatus 100, wherein the fixing roller 101 and the separation roller 103 rotate as shown with arrows and the recording material P is interposed by the fixing roller 101 and by the fixing belt 105 to be conveyed, and a toner image is heated and fixed on the recording material P in fixing nip N.

The recording material P after being subjected to fixing processing, is separated from the fixing roller 101 due to a small radius of curvature of separation roller 103 and to a direct advance of recording material P. Namely, the recording material P advances to be oriented in the direction to separate from the fixing roller 101 when the recording material P leaves the fixing nip N, because the separation roller 103 digs into the fixing roller 101, thereby the recording material P is separated from the fixing roller 101 for certain.

In the fixing process, the fixing belt 105 slides on sliding member 106*e* for rotating, and the sliding member 106*e* is a member to reduce sliding resistance of the fixing belt 105, and heat resistant sheet made of PI is used as the sliding member 106*e*.

Further, for reducing sliding resistance, a height and 0.2 mm unevenness are formed on a surface (surface coming in contact with the fixing belt 105) of the sliding member 106*e* by embossing process, and an area of contact with fixing belt 105 is reduced.

For reducing sliding resistance, lubricants are further used. In other words, lubricants are coated by coating member 114 on an inner circumferential surface representing a surface on the side coming in contact with the sliding member 106*e* of the fixing belt 105. As the coating member 114, a blade or a roller that is made of a heat resistant fiber such as an alamido fiber and PTFE fiber is used. As a lubricant, dimethyl silicon oil, amino denatured silicon oil and fluorine denatured oil are used.

FIG. 12 is a diagram showing a drive system of fixing apparatus 100.

M1 represents a motor serving as a drive section that drives fixing roller 101 and separation roller 103, and fixing process and lubricant coating process which will be explained later are carried out by the drive of the motor M1.

Entrance roller 102, separation roller 103 and pressure applying member 106 are supported by supporting frame 110. A rotary shaft of the entrance roller 102 is fixed on the supporting frame 110, the separation roller 103 is supported by supporting arm 111*a* and the pressure applying member 106 is supported by supporting arm 111*b*. The supporting arms 111*a* and 111*b* are supported by supporting stand 110*b* that is a part of supporting frame 110 through respective springs 115*a* and 115*b*. As stated above, the separation roller 103 and the pressure applying member 106 are caused by elastic forces of springs 115*a* and 115*b* to come in pressure contact with the fixing roller 101 through fixing belt 105.

The supporting frame 110 is rotatable on axis 110*a*, and it is rotated by the rotation of cam 113 serving as a pressing force change section that is driven by motor M2 to rotate.

FIGS. 13A-13C respectively show the state of the fixing apparatus in fixing process established by rotation of supporting frame 110 [FIG. 13A], the state of the fixing apparatus in a pause time [FIG. 13B], and the state of the fixing apparatus in the lubricant coating process [FIG. 13C]. The states shown in FIGS. 13A-13C are established by setting cam 113 to a prescribed angle by rotation of motor M2. In the fixing process which is in the state shown in FIG. 13A, fixing roller 101 and separation roller 103 are rotated by motor M1 and fixing belt 105 is mainly driven by fixing roller 101 to rotate. In a pause time that is under the state shown in FIG. 13B, the fixing roller 101 and the separation roller 103 are stopped, and the fixing belt 105 also is stopped accordingly. In the lubricant coating process shown in FIG. 13C, the fixing roller 101 and the separation roller 103 are rotated by motor M1, and the fixing belt 105 is driven mainly by separation roller 103 to go around.

In the fixing process shown in FIG. 13A, a toner image on a recording material is fixed on the recording material. The pressure applying member 106 and the separation roller 103 press the fixing belt 105 against the fixing roller 101 with high pressure that allows sufficient fixing strength. Under the state shown in FIG. 13A, a recording material is interposed and conveyed to fixing nip N so that fixing may be carried out. Coating member 114 representing a lubricant coating device comes in contact with fixing belt 105, so that lubricants are coated on an inner circumferential surface of fixing belt 105 by going around of the fixing belt 105.

In a pause time shown in FIG. 13B, separation roller 103 and pressure applying member 106 are separated from fixing roller 101. The fixing belt 105 is in contact with fixing roller 101 slightly. In the state of a pause time, it is important that the separation roller 103 and the pressure applying member 106 are separated from fixing roller 101, and this prevents permanent set of the fixing roller 101 and of the pressure applying member 106. Under the state of a pause time, the fixing belt 105 may either be separated from or be in contact with the fixing roller 101.

In the lubricant coating process shown in FIG. 13C, lubricants are coated on sliding member 106*e* on a surface of pressure applying member 106, and a lubricant film is formed. Fixing belt 105 and sliding member 106*e* of pressure applying member 106 are in contact each other under the pressure that is smaller than the pressure in the fixing process. In this case, it is needed that an entire surface of sliding member 106*e* to be in contact with the fixing belt is in contact with fixing belt 105. Further, the coating member 114 serving as a lubricant coating device is in contact with the fixing belt 105, and is in the state to coat lubricants. The state shown in FIG. 13C, namely, the state to cause the fixing belt 105 and pressure applying member 106 to be in contact each other at lower pressure is established by causing the pressure applying member 106 to be in contact with the fixing belt 105 under the pressing force that is smaller than that in the fixing process. Incidentally, though the separation roller 103 is separated from fixing roller 101 in the state shown in FIG. 13C, the separation roller 103 may also be in contact with the fixing roller 101.

When fixing roller 101 and separation roller 103 are rotated by drive of motor M1 (see FIG. 12) in the state shown in FIG. 13C, the fixing belt 105 is caused to go around mainly by drive of separation roller 103, and lubricants are coated on an inner circumferential surface of fixing belt 105. When lubricants are coated under the state of low pressure contact between the fixing belt 105 and the pressure applying member 106, lubricants on the inner circumferential surface of the fixing belt 105 stick to a surface of sliding member 106*e*, and a uniform lubricant film is formed also on the surface of sliding member 106*e*. Further, it is preferable that the pressure applying member 106 is caused to touch under pressure after the fixing belt 105 is caused to go around several times to form a lubricant film on an inner circumferential surface of the fixing belt 105.

Meanwhile, heater 107 in FIGS. 10A-10B is a heating device to heat fixing belt 105, in the fixing process and in the lubricant coating process. In the fixing process, fixing belt 105 is heated by heater 107, and recording material P is heated on the reverse side. If the fixing belt 105 is heated by the heater 107 even in the lubricant coating process, viscosity is lowered and more uniform lubricant coating is achieved because a temperature of lubricants sticking to an inner circumferential surface of the fixing belt 105 rises. Further, it is preferable to heat an inner circumferential surface of the fixing belt 105 and the surface of the sliding member 106*e*, because the lubricant film can be formed easily under high temperatures. It is preferable to make a temperature of the fixing belt to be 100° C. or more. In the lubricant coating process, the fixing belt 105 and sliding member 106*e* are heated sufficiently and an excellent lubricant film is formed, by heating the fixing belt 105 with heater 107.

In the state shown in FIG. 13C, the fixing belt 105 and sliding member 106*e* are in contact with each other under the pressure that is lower than that in the fixing process. Under the low contact pressure, abrasion of the fixing belt 105 and sliding member 106*e* can be avoided, and lubricants are coated on the surface of sliding member 106*e* to form a lubricant film. When pressure is applied under the condition of pressure that is higher than that in the fixing process, abrasion is accelerated to be faster than the speed for a lubricant to be coated on sliding member 106*e* to become a lubricant film, resulting in no formation of a lubricant film. After the lubricant film is formed once, wear and tear hardly take place, and sliding resistance is low even when high pressure is applied in the fixing process in the state shown in FIG. 13A.

Coating of lubricant in the state shown in FIG. 13C is carried out, prior to the start of an image forming process. In particular, coating of lubricant in the state shown in FIG. 13C is carried out, prior to operations of the apparatus that is an unused new article. In the case of an unused new article, high sliding resistance between the fixing belt 105 and sliding member 106*e* is generated if the fixing process is conducted under this condition, because lubricants have not been coated yet on the fixing belt 105 and on pressure applying member 106. Due to this, the fixing belt 105 and the sliding member 106*e* are worn away, and these parts are deteriorated at an early date.

Further, prior to the start of image forming after the pausing time that is longer than a prescribed time, lubricant coating in the state shown in FIG. 13C is carried out. In addition, lubricant coating in the state shown in FIG. 13C is carried out, prior to the start of image forming under the environment of a low temperature that is lower than the prescribed temperature. When a pausing time is long or when an environment is at a low temperature, there is sometimes an occasion where a sliding resistance of the fixing belt 105 grows greater. The reason for this is considered to be the phenomenon wherein, even when the fixing roller 101 and the fixing belt 105 become to be at the temperature that is an established temperature in the fixing process, a surface temperature of sliding member 106*e* is low and viscosity μ of a lubricant film is high, or the state of the lubricant film has been changed. If the fixing apparatus operates under the state of high sliding resistance, a temperature of the lubricant film is raised by carrying out the lubricant coating process in the state shown in FIG. 13C, or the wear and tear of this kind are prevented by forming of the fresh lubricant film, although the aforesaid wear and tear identical to those for the new article progress.

The aforesaid prescribed time and the aforesaid prescribed temperature are established in advance.

Examples

Apparatus Conditions

Fixing Roller:

Outer diameter 65 mm,

Silicon rubber layer with thickness of 1.5 mm and PFA surface layer with thickness of 30 μm on core metal with thickness of 5 mm made of aluminum Separation Roller:

Outer diameter 23 mm,

Metal bar made of stainless steel

Fixing Belt:

Silicon rubber layer with thickness of 200 μm and PFA layer with thickness of 30 μm on PI with thickness of 70 μm Pressure Applying Pad:

Silicon rubber layer with thickness of 3 mm and with hardness of JISA20° on an aluminum base plate Lubricant Coating Member:

Coating blade made of nonwoven fabric of alamido fiber

Sliding Member:

Embossed PI sheet

Lubricant:

Dimethyl silicon oil viscosity 300 cs

Process Conditions

Sheet:

Plain paper (Basis weight 80 g/m$^2$), A4 size, cross-feed

Sheet Feeding Speed:

65 sheets/minute

Pressing Member Pressing Load:

50 kg in fixing process 5 kg in lubricant coating process

Lubricant Coating Time:

5 minutes

Ambient Temperature:

23° C.-26°

Example 4

Performing lubricant coating process only for zero sheet per hour

Example 5

Performing lubricant coating process for zero sheet per hour and for the start of image forming after overnight standing Comparative Example 2

No Lubricant Coating

Test results are shown in FIG. 14. In FIG. 14, the ordinate represents load torque applied on fixing drive motor, and the abscissas represents the number of prints.

The image forming apparatus is adjusted so that the apparatus operates normally in the initial state. Therefore, the initial state of Comparative Example 2 was made to be the normal state, and the load torque in the initial state of Comparative Example 2 was made to be 1 that is a reference value.

Operations to make 25000 prints per day were repeated, and torques applied on a drive motor in the start of printing and torques applied on a drive motor in the termination of printing were measured. In the graph shown in FIG. 14, symbol ■ shows data in Example 4, symbol ▲ shows data in Example 5 and symbol ♦ shows data in Comparative Example 2, respectively. A part of data shown in FIG. 14 is shown as pairs arranged lengthwise, and data shown as pairs are the data in the case of termination of image forming and the data in the case of starting image forming, while, data which are not pairs show that there was no difference to appear in the graph between the data in the case of termination of image forming and the data in the case of starting of image forming.

In FIG. 14, an area below level L is a tolerance, and when torque is higher than level L, troubles such as image slippages were caused. As illustrated, Examples 4 and 5 were excellent for printing of 30,000 copies, but in Comparative Example 2, there was a torque rise exceeding the level L, and image slippages were caused. Further, in the Comparative Example 2, a rate of rise of torque was high, and deteriorations of the fixing belt and of the pressure applying members progressed.

In the present embodiment, it is possible to form a lubricant film for surface of sliding member that covers a pressure applying member, because lubricant is coated by causing the fixing belt and the pressure applying member to touch each other under the condition where pressing force of pressure applying member is made to be lower than that in the fixing process. Owing to this, the sliding resistance between the fixing belt and the pressure applying member is reduced sufficiently, and a decline of image quality occurring in the course of fixing can be prevented, and deteriorations of the fixing belt and of the pressure applying member caused by their abrasion can be prevented.

What is claimed is:

1. An image forming apparatus comprising:

(a) a fixing apparatus having:

(1) a heating section and (2) a pressing section that forms a fixing-nip portion by being in pressure contact with the heating section, wherein at least one of the heating section and the pressing section comprising:

(i) an endless fixing belt that is trained about a plurality of rollers, (ii) a pressure applying member that causes the fixing belt to be in pressure contact with a side of the fixing-nip portion from an inner circumferential surface thereof, and (iii) a lubricant supplying member that supplies lubricant to the inner circumferential surface of the fixing belt; and (b) a supplying amount change section that changes a supplying amount of the lubricant by the lubricant supplying member based on an amount used coming from a part replacement of at least one of the fixing belt, the pressure applying member and the lubricant supplying member.

2. The image forming apparatus of claim 1, wherein the lubricant supplying member is in contact with one of the plurality of rollers, and the supplying amount change section changes a supply amount by changing at least one of a contact pressure of the lubricant supplying member against the roller and a contact width between the roller and the lubricant supplying member.

3. The image forming apparatus of claim 1, wherein one of the plurality of rollers is a heating roller having therein a built-in heater, which is in contact with an inside of the fixing belt, the lubricant supplying member is in contact with the heating roller, and the supplying amount change section changes a supplying amount by changing a controlled temperature of the built-in heater.

4. The image forming apparatus of claim 1, further comprising an operation and display section which displays information of a supplying amount of the lubricant and enables an operator to manually operate the supplying amount change section, based on the amount used coming from the part replacement.

5. The image forming apparatus of claim 1, wherein the lubricant supplying member includes a plurality of lubricant supplying members, and a supplying amount of each of the plurality of lubricant supplying members is different from each other, and a change of the supplying amount of the supplying amount change section is made by switching the lubricant supplying member to be used.

6. The image forming apparatus of claim 1, wherein the pressure applying member comprises a pressure contact releasing section that can switch to a state of pressure contact releasing, and when changing a supplying amount so that the supplying amount change section increases a supplying amount, the pressure applying member is caused to be in the releasing state by the pressure contact releasing section, and lubricant coating process wherein the fixing belt is rotated is carried out.

7. An image forming apparatus comprising:

(a) a fixing apparatus having:

(1) a heating section and (2) a pressing section that forms a fixing-nip portion by being in pressure contact with the heating section, wherein at least one of the heating section and the pressing section comprising:

(i) an endless fixing belt that is trained about a plurality of rollers, (ii) a pressure applying member that causes the fixing belt to be in pressure contact with a side of the fixing-nip portion from an inner circumferential surface thereof, and (iii) a lubricant supplying member that supplies lubricant to the inner circumferential surface of the fixing belt; and (b) a supplying amount change section that changes a supplying amount of the lubricant by the lubricant supplying member based on a pause time counted from an interruption of operations of the fixing apparatus.

8. An image forming apparatus comprising:

(a) a fixing apparatus having:

(1) a heating section and (2) a pressing section that forms a fixing-nip portion by being in pressure contact with the heating section, wherein at least one of the heating section and the pressing section comprising:

(i) an endless fixing belt that is trained about a plurality of rollers, (ii) a pressure applying member that causes the fixing belt to be in pressure contact with a side of the fixing-nip portion from an inner circumferential surface thereof, and (iii) a lubricant supplying member that supplies lubricant to the inner circumferential surface of the fixing belt;

(b) a drive current measuring section that measures a drive current of a drive motor that drives the fixing belt; and (c) a supplying amount change section that changes a supplying amount of the lubricant by the lubricant supplying member based on a measured value of the drive current measuring section.

* * * * *